US005083740A

United States Patent [19]

Sawyer et al.

[11] Patent Number: 5,083,740

[45] Date of Patent: Jan. 28, 1992

[54] SPRING-LOADED LOCKING PIN FOR CONCRETE FORMS

[76] Inventors: Robert D. Sawyer, 6365 S. 20th St., #15, Oak Creek, Wis. 53154; Bruce H. Peterson, 15373 Sandhill Cir., Eden Prairie, Minn. 55347

[21] Appl. No.: 723,779

[22] Filed: Jul. 1, 1991

Related U.S. Application Data

[63] Continuation-in-part of Ser. No. 559,890, Jul. 30, 1990.

[51] Int. Cl.[5] ..... E04G 17/04; F16B 41/00

[52] U.S. Cl. ..... 249/219.1; 249/47; 249/196; 267/159; 267/164; 411/347; 411/544; 411/552

[58] Field of Search ..... 249/6, 44, 45, 47, 165, 249/166, 191-196, 219.1; 411/347, 351, 354, 544, 552, 916; 267/158, 159, 164, 262

[56] References Cited

U.S. PATENT DOCUMENTS

| | | | |
|---|---|---|---|
| 1,980,726 | 11/1934 | Higbee | 267/158 |
| 1,981,439 | 11/1934 | Smith | 267/164 |
| 2,041,775 | 5/1936 | Mottlau | 267/159 |
| 2,561,405 | 7/1951 | O'Brien et al. | 267/159 |
| 2,713,206 | 7/1955 | Zelnick | 267/158 |
| 3,192,551 | 7/1965 | Appel | 267/158 |
| 3,385,555 | 5/1968 | Williams | 249/192 |
| 3,862,737 | 1/1975 | Fuston, Jr. | 249/47 |
| 3,877,674 | 4/1975 | Cerutti | 249/196 |
| 4,194,717 | 3/1980 | Easton et al. | 249/192 |
| 4,708,315 | 11/1987 | Carlson et al. | 249/192 |
| 4,744,541 | 5/1988 | Carlson et al. | 249/192 |
| 4,975,009 | 12/1990 | Easton et al. | 249/192 |

FOREIGN PATENT DOCUMENTS

| | | | |
|---|---|---|---|
| 2501311 | 9/1982 | France | 249/192 |
| 2515716 | 5/1983 | France | 249/196 |

OTHER PUBLICATIONS

P. 16 of Durand Manufacturing Inc. Brochure.

Western Forms, Inc. brochure featuring "PinLock".

*Primary Examiner*—James C. Housel

*Attorney, Agent, or Firm*—Palmatier & Sjoquist

[57] ABSTRACT

An attached locking pin for releasably securing adjacent concrete forms used in the formation of poured concrete. Such concrete forms are characterized by having a peripheral rail with apertures therethrough adapted to abut the rail and align the apertures of an adjacent form to hold the cement in its desired shape until the concrete has set. The attached locking pin includes a sleeve with an opening therethrough adapted to interlock within one of the aligned apertures of abutting rails. A pin is provided having a head and an end with an intermediate portion having a slot passing therethrough typically for receiving a locking wedge. The pin is adapted to pass the end and slotted intermediate portion through the sleeve and the adjacent aligned aperture to releasably hold the abutting rails securely together after the wedge is driven into the slot. A flexible retainer is attached to the sleeve and the pin adjacent the pin head to prevent loss of the pin and to facilitate quick set up and strip down of the concrete forms.

9 Claims, 4 Drawing Sheets

SPRING-LOADED LOCKING PIN FOR CONCRETE FORMS

BACKGROUND OF THE INVENTION

This is a continuation-in-part of U.S. patent application Ser. No. 559,890, filed July 30, 1990.

This invention relates to an attached locking pin for releasably securing adjacent concrete forms used in the formation of poured concrete such as in walls.

Although walls are still formed by cement blocks in an upwardly staggered row fashion, for the last several decades poured cement walls have met with increasing popularity principally due to reduced materials and labor costs.

The formation of poured walls first requires the building of forms which will retain the poured concrete in its desired shape until the concrete has set and at least partially cured. Forms have been built out of plywood sheets that have been held in their particular arrangement by supporting wooden braces or cross members which give the forms adequate strength to support the poured concrete.

Concrete forms are also made from prefabricated metal panel units which are designed for ease of assembly and disassembly, and frequently have pins or other mechanisms for interlocking the panels, where the interlocking mechanism is constructed as a permanent part of the panel itself. For example, U.S. Pat. No. 4,194,717, issued Mar. 25, 1980, shows one form of panel interlocking mechanism, wherein brackets are welded to the panel and the bracket support pins which may be retracted during periods of nonuse and withdrawn with the panel is to be interlocked with an adjacent panel. U.S. Pat. No. 4,975,009, issued Dec. 4, 1990, shows another form of permanently installed brackets for use in connection with interlocking pins. U.S. Pat. No. 3,862,737, issued Jan. 28, 1975, U.S. Pat. No. 3,877,674, issued Apr. 15, 1975, and U.S. Pat. No. 3,385,555, issued May 28, 1968, all show further types of concrete panel and interlocking constructions. All of the foregoing devices require special panel designs to accommodate the interlocking pin mechanism, and therefore increase the cost of manufacture of concrete form panels.

The use of pins for aligning adjacent rails and interconnecting locking means to hold the pins in place as well as to hold the adjacent side rails in close abutment have met with several problems. Naturally, if the pins are not attached to the forms in some fashion, they are prone to being lost. Known methods of attaching the pins to the forms while yet permitting a sliding movement of the pins into the rail apertures are complicated and quite awkward as well as being expensive to manufacture.

It is desirable to have an attached locking pin for releasably securing adjacent concrete forms used in the formation of poured concrete that is simple to manufacture and install, easy to operate, not subject to being lost and facilitates quick set up and strip down of the concrete forms.

SUMMARY OF THE INVENTION

The invention comprises an attached locking pin for releasably securing adjacent concrete forms used in the formation of poured concrete. Such concrete forms are characterized by having a peripheral rail with apertures therethrough adapted to abut the rail and align the apertures of an adjacent form to hold poured concrete in its desired shape until the concrete has set. The attached locking pin is comprised of a sleeve with an opening therethrough adapted to interlock within the aperture of a peripheral rail of such a panel form. A pin is provided having a head and a tapered end, with an intermediate portion having a slot passing therethrough, typically for receiving a locking wedge. The pin is adapted to pass the tapered end and slotted portion through the sleeve and through an adjacent form aligned aperture to hold the abutting rails securely together after a wedge is driven into the slot. A retainer is attached to the sleeve and the pin adjacent the pin head to prevent loss of the pin and to facilitate quick set up and strip down of the concrete forms.

A principal object and advantage of the present invention is that the attached locking pin is secured to the form in a simple, inexpensive and easily operable fashion to prevent loss of the pin.

Another advantage and object of the present invention is that the attached locking pin facilitates quick set up and strip down of the concrete forms holding the slotted pin in correct alignment with the apertures while yet biasing the pin away from the apertures.

A further advantage and object of the present invention is that it may be utilized with preexisting concrete panel forms, without any special preparation of the forms.

Another object and advantage of the present invention is it may be utilized as a permanent locking pin attachment, but does not require any special brackets or other mechanical modification to the concrete panel forms to facilitate its use.

BRIEF DESCRIPTION OF THE DRAWINGS

FIG. 7 is an elevational view of the present invention connecting aluminum forms shown in broken outline;

DETAILED SPECIFICATION

Figure 1:
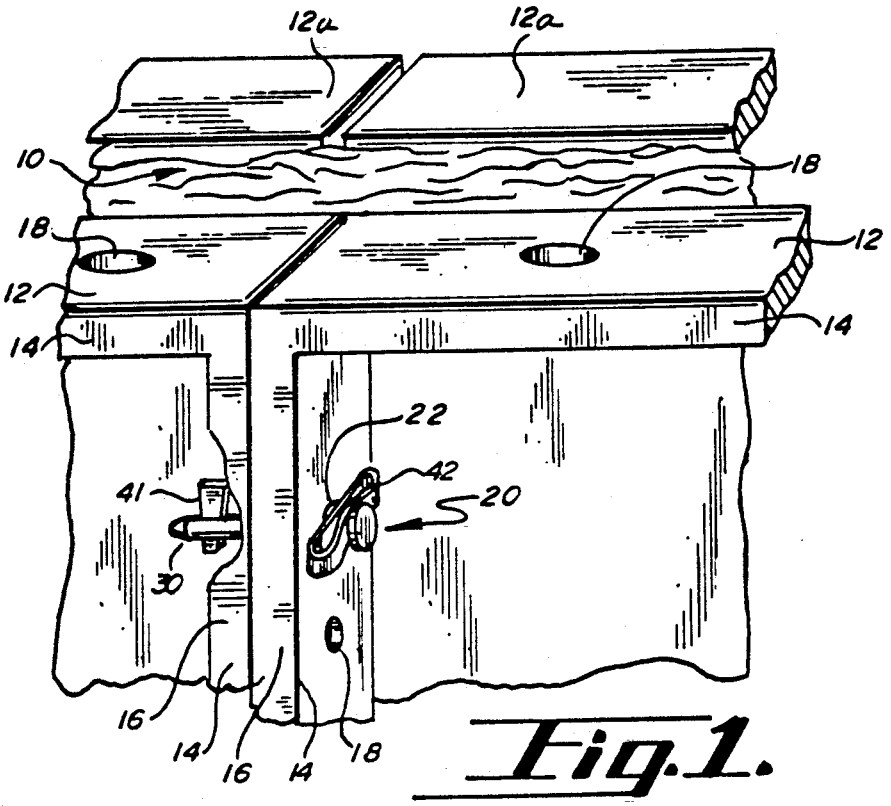
FIG. 1 is a perspective view of the present invention as used with aluminum forms in pouring concrete walls.
Figure 2:
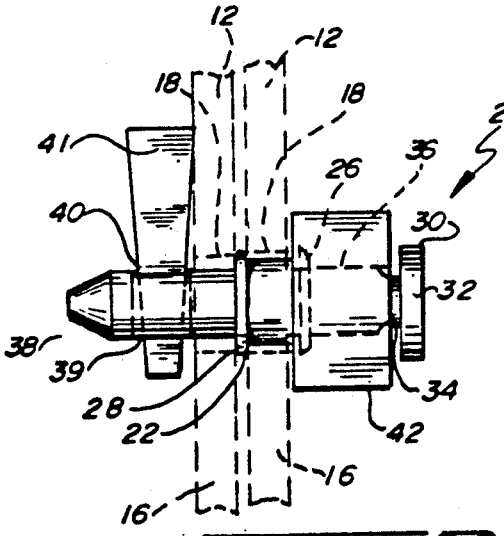
FIG. 2 is an end view of the sleeve of the present invention.

Referring to FIGS. 1–7, the attached locking pin 20 for concrete forms 12, which have peripheral rails 14 with prearranged and matchable apertures 18, generally includes sleeve 22, slotted pin 30, and retainer 42.

More specifically, locking pin 20 includes a sleeve 22 suitably made of plastic. Sleeve 22 is designed to be fitted and retained within a peripheral rail aperture 18 which presently is known to have a diameter of approximately 11/16 inch. Sleeve 22 appropriately has an opening 24 therethrough illustratively having a diameter of 9/16 inch. Sleeve 22 also has two raised surfaces in the form of a chamfered or beveled annular lip 26 and a retaining annular lip 28. Lips 26 and 28 appropriately may be 1/16 inch thick. Retaining annular lip 28 is suitably 14/16 inch in diameter to prevent its passing through apertures 18. Chamfered or beveled lip 26 has its beveled surface facing outwardly from retaining lip 28 as shown and suitably has a diameter of approximately 13/16 inch. By this arrangement, the beveled lip 26 will pass through aperture 18 under some resistance but will lock sleeve 22 within aperture 18 after the beveled lip 26 passes out of aperture 18. Beveled lip 26 will not readily pass back through aperture 18 in reverse direction.

Slotted pin 30 suitably may be made of a metal such as steel. Pin 30 illustratively has been found to work well with a length of approximately 3 inches and a diameter of 9/16 inch to readily pass through opening 24 of sleeve 22, adjacent aperture 18 and be of a sufficient length and strength to interlock the side rails 16 of aluminum forms 12. Slotted pin 30 has a head 32 with a diameter larger than that of opening 24 or 9/16 of an inch, such as 15/16 inch. Adjacent head 32 on slotted pin 30 is annular recess, channel or groove 34 which is formed on elongate shaft 36 which terminates in a chamfered end 38. Shaft 36 has an intermediate portion 39 wherein a slot 40 is axially aligned therewith. Slot 40 will receive a wedge 41 which will lock slotted pin 30 within aligned matching apertures 18. The further forcing of wedge 41 into slot 40 will tighten the slotted pin 30's binding of side rails 16 together to prevent the leakage of cement between aluminum forms 12 and to assure a smooth finished surface of poured concrete 10.

Attached locking pin 20 also includes a retainer 42 suitably made of an elongate plastic strap, band or circle which preferably offers some resilience, flexibility and resistance to bending. Band 42 appropriately is approximately greater than twice the length of slotted pin 30. Band 42 suitably has a central pin aperture 44 which will permit the retainer 42 to be locked in association with slotted pin 30 at annular groove 34. Band 42 suitably also has two distal sleeve apertures 46 which will readily pass over beveled lip 26 of sleeve 22 and will interlock the retainer 42 with sleeve 22 as is shown.

Figure 6:
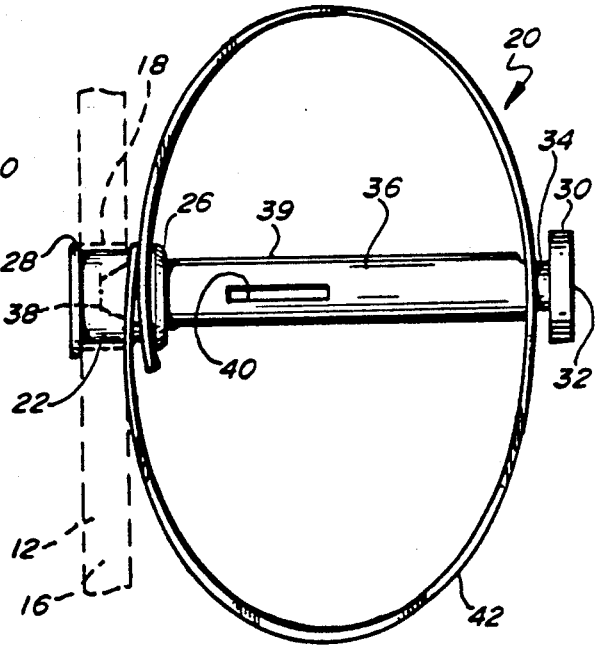
FIG. 6 is a top plan view of the present invention attached to a aluminum form in broken outline.
Figure 4:
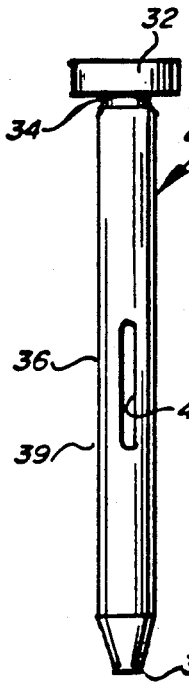
FIG. 4 is an elevational view of the slotted pin of the present invention
Figure 5:
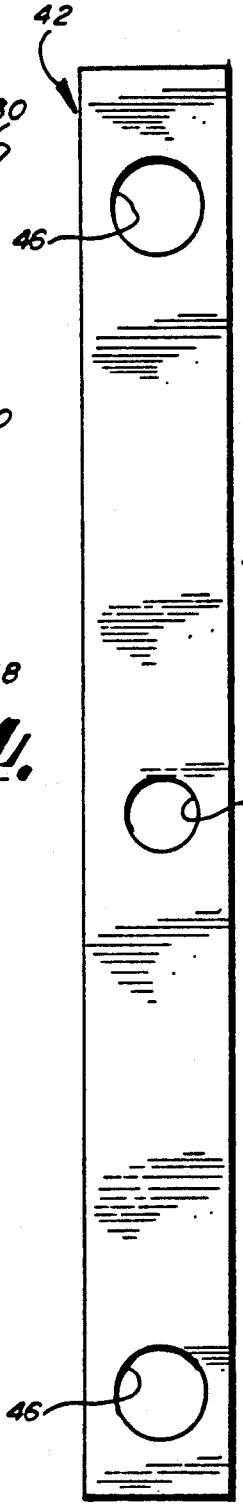
FIG. 5 is an elevational view of the retaining strap or band of the present invention.

Referring to FIGS. 1, 6 and 7, the use and operation of attached locking pin 20 for concrete forms 12 may now be understood and appreciated. Initially, sleeve 22 has its beveled lip 26 driven through one of the matching or aligned apertures 18 of rails 14, such as side rails 16 which abut against each other. As beveled lip 26 passes through the other side of aperture 18, sleeve 22 effectively becomes locked within aperture 18. The central pin aperture 44 is slid over the elongate shaft 36 of slotted pin 30 until the aperture 44 is interlocked with annular groove 34 of slotted pin 30. Next, the chamfered end 38 of slotted pin 30 is guided through the sleeve apertures 46 of retainer 42 and partially into the opening 24 of sleeve 22 after which sleeve apertures 46 are interlocked onto sleeve 22 as they are slid over and held by beveled lip 26.

Alternatively, sleeve 22 may have its beveled lip 26 driven through sleeve apertures 46 from inside the band or retainer 42. The slotted pin 30 is driven through central pin aperture 44, sleeve 22 and aperture 18 until beveled lip 26 of sleeve 22 is interlocked with aperture 18.

By this arrangement, slotted pin 30 is always held in alignment with opening 24 of sleeve 22 and is biased outwardly to not interfere with the abutment of adjacent side rails until the side rails 16 are ready to be interlocked.

Side rails 16 are interlocked after their associated and aligned apertures 18 are brought together and slotted pin 30 is simply driven through opening 24 of sleeve 22 and through the associated aperture 18 of the adjacent form 12. Thereafter, wedge 41 is driven into slot 40 until slotted pin 30 tightly holds side rail 16 together. The release of locking pin 20 is performed by the removal of wedge 41 and the tapping of chamfered end 38 of slotted pin 30 which is assisted by the natural bias or resilient action of plastic band 42 after which the slotted pin 30 is held in proper alignment within opening 24 for the next interlocking of aluminum forms 12.

Figure 8:
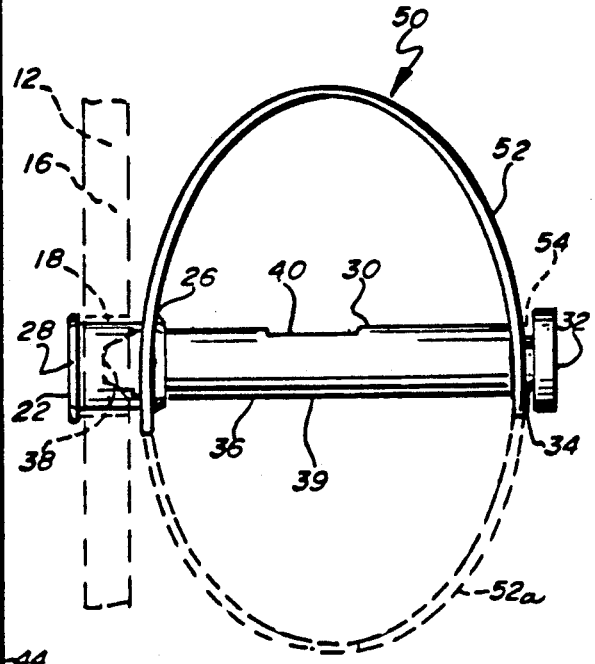
FIG. 8 is a top plan view of modified form of the present invention attached to an aluminum form shown in broken outline.
Figure 3:
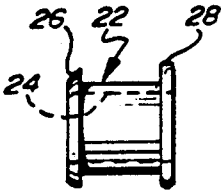
FIG. 3 is a side view of the sleeve of the present invention.
Figure 2:
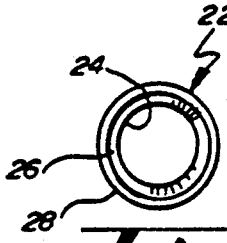

Referring to FIG. 8, a modified version of attached locking pin 15 may be seen. The retainer may be a short band 52 or a circular segment 52 and 52*a* of extruded tubing. All components are essentially the same of locking pin 50 as in locking pin 20 with the exception that retainer 52 only has one sleeve aperture 56 and a pin aperture 54. In all other respects, the operation of modified locking 50 with its sleeve 22, slotted pin 30 and retainer 50 is essentially as locking pin 20.

Figure 9:
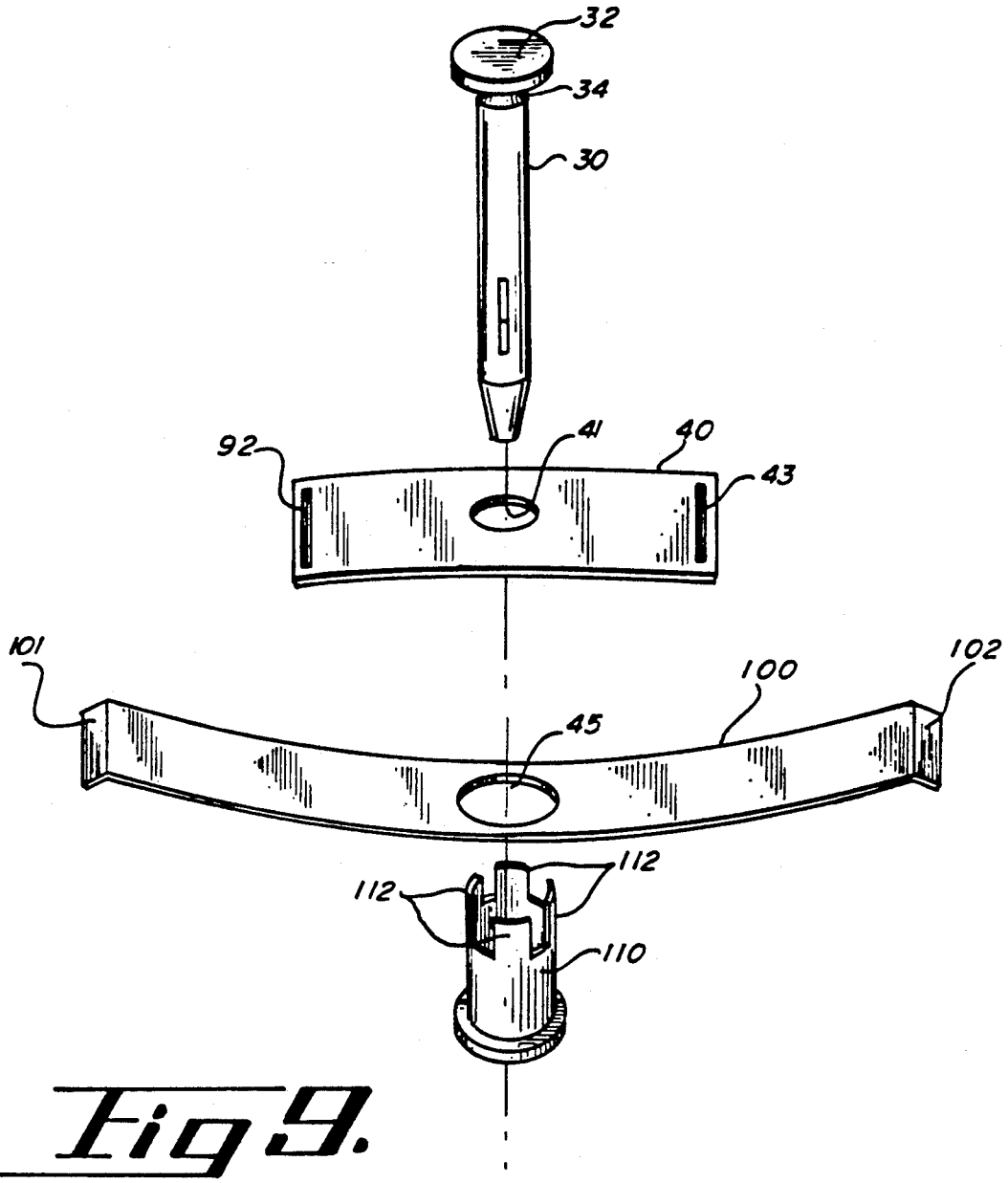
FIG. 9 shows another form of the invention in exploded view.

FIG. 9 shows an alternative form of the invention in exploded view. The slotted pin 30 is utilized as before, with an annular groove 34 about its circumference just beneath head 32. Pin 30 is inserted through opening 91 in spring member 90, and is further inserted through opening 95 in spring member 100, and is further inserted through bushing 110. Spring member 90 is preferably made of steel or other metal, and has a pair of slots 92, 93 respectively adjacent each end. Slots 92, 93 are sufficiently wide to accommodate insertion of spring member 100, and spring member 100 has downwardly bent end tabs 101, 102 which engage against spring member 90 after insertion, to prevent spring member 100 from slipping out of contact with spring member 90. Bushing 110 preferably has a number of bendable ears 112 which will be further described with reference to FIGS. 10A and 10B.

Figure 10B:
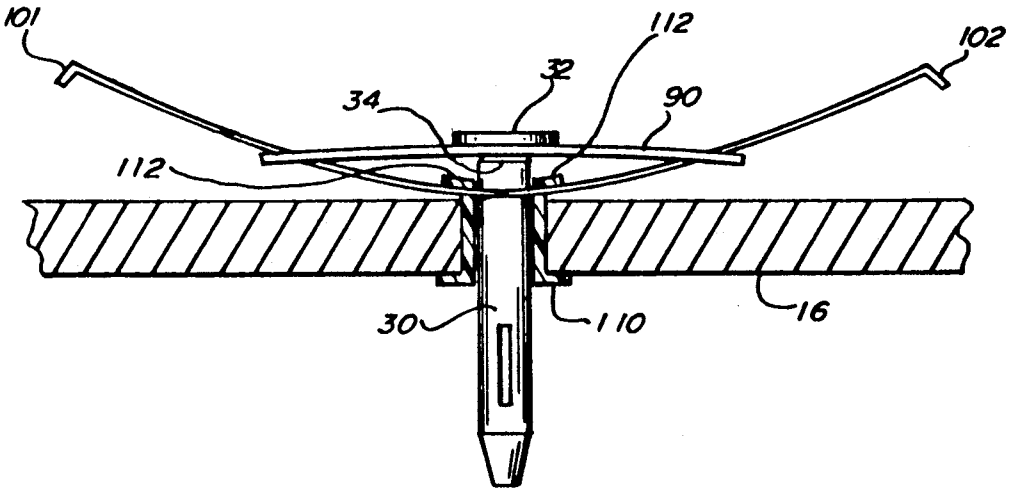
FIG. 10B shows the same device in a use position.
Figure 10A:
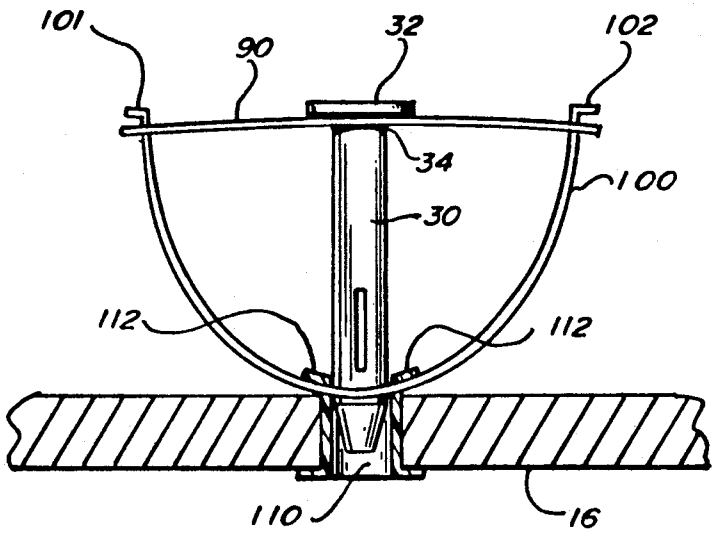
FIG. 10A shows the device of FIG. 9 attached to a panel in storage position.

FIG. 10A shows spring member 90 in its operative position, wherein opening 91 is seated in annular groove 34 of pin 30. Spring member 110 is affixed to a side rail 16 by bushing 110, wherein tabs 112 are outwardly bent to clamp spring member 110 closely adjacent rail 16. After spring member 100 has been inserted through the slots in spring member 90, tabs 101, 102 prevent spring member 101 from slipping completely through spring member 90, as shown.

FIG. 10B shows the device engaged against the side rail 16 in position for operatively connecting to an adjacent side rail. In this position, pin 30 has been inserted through an opening in the side rail 16 by a downward force, causing spring member 100 to snap through an over-center position and slide through the slots and spring member 90 to the position shown. In this position, the spring bias of spring member 100 holds pin 30 in a position projecting through side rail 16, ready to accommodate the interlocking operation with an adjacent side rail. It is to be appreciated that the device of FIGS. 10A, 10B has two stable positions as shown in the respective figures. The stable position of FIG. 10A is a storage position, wherein pin 30 is held in the opening through side rail 16, but withdrawn from projection through the opening. In the stable position of FIG. 10B, pin 30 is held in a position projecting through the opening and side rail 16. In order to return pin 30 from its position in FIG. 10B to its position in FIG. 10A, it is only necessary to exert an upward force against the bottom of pin 30, which not only retracts pin 30 from the opening but also causes the spring members 90, 100 to reengage in the position shown in FIG. 10A.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. A locking pin and spring mechanism for attachment to a concrete form for operative use in two stable positions, comprising:

a) a leaf spring member having a central opening therethrough and bushing means for attaching through said central opening to affix said leaf spring member to a concrete form;

b) a plate having a central opening therethrough and having a slot proximate each end, said slots having dimensions slidably accommodating respective ends of said leaf spring; and c) a locking pin affixed in said plate central opening and having an end insertable through said bushing means and said central opening of said leaf spring member; whereby said pin may be held in either of two stable insertion positions relative to said bushing by said leaf spring engaging against said plate.

2. The apparatus of claim 1, wherein said leaf spring further comprises a tab at each of its ends, said tabs preventing said leaf spring from becoming disengaged with said plate.

3. An apparatus for holding side rails of adjacent concrete forms together comprising:

a) a leaf spring having a central opening alignable with a corresponding opening in one of said side rails, said leaf spring having a predetermined length with a bent tab at each of its ends, and a bushing means attached through the central opening for affixing said leaf spring to the side rail of a concrete form; and b) a plate having a central opening therethrough, with means for affixing a locking pin in said central opening, said plate having a length substantially shorter than said leaf spring length, and said plate having a transverse slot adjacent each of its ends with respective ends of said leaf spring inserted through said slots; and c) a locking pin affixed in said central opening of the plate and having an end inserted through the bushing means and said central opening of the leaf spring.

4. The apparatus of claim 3, wherein said leaf spring bent tabs each comprise a bend in said leaf spring of about 90°.

5. The apparatus of claim 4, wherein said plate further comprises a steel plate.

6. The apparatus of claim 5, wherein said leaf spring further comprises a steel leaf spring.

7. The apparatus of claim 4, wherein said bushing means has respective end flanges to affix said leaf spring to said side rail.

8. The apparatus of claim 7, wherein the length of said plate is approximately one-half the length of said leaf spring.

9. The apparatus of claim 8, wherein said plate further comprises a bend toward said leaf spring at the position of each of said slots.

* * * * *